United States Patent [19]

Bouchard et al.

[11] Patent Number: 5,025,190

[45] Date of Patent: Jun. 18, 1991

[54] GLOW DISCHARGE LAMP

[75] Inventors: Andre C. Bouchard, Peabody; Paul A. Thibault, Danvers; Lagushenko Radomir, Brookline; Jakob Maya, Brookline; Jakob Maya, Brookline, all of Mass.

[73] Assignee: GTE Products Corporation, Danvers, Mass.

[21] Appl. No.: 139,396

[22] Filed: Dec. 30, 1987

[51] Int. Cl.[5] ..... H01J 61/64

[52] U.S. Cl. ..... 313/619; 313/493; 313/609; 313/610; 313/613; 313/621

[58] Field of Search ..... 313/619, 620, 621, 609, 313/610, 613, 573–575, 493, 491, 634, 316, 565, 578, 580

[56] References Cited

U.S. PATENT DOCUMENTS

| | | | |
|---|---|---|---|
| 2,267,092 | 12/1941 | Gustin | 313/609 X |
| 2,341,990 | 2/1944 | Inman et al. | 313/619 X |
| 2,363,070 | 11/1944 | Lemmers | 313/634 |
| 2,887,766 | 5/1959 | Le Van | 313/619 X |
| 3,052,815 | 9/1962 | Sperti et al. | 313/574 X |

FOREIGN PATENT DOCUMENTS

| | | | |
|---|---|---|---|
| 2575600 | 7/1986 | France | 313/491 |
| 55-66851 | 5/1980 | Japan | 313/634 |
| 125614 | 7/1949 | Sweden | 313/493 |

*Primary Examiner*—Donald J. Yusko
*Assistant Examiner*—Michael Horabik
*Attorney, Agent, or Firm*—Carlo S. Bessone

[57] ABSTRACT

A glow discharge lamp that includes a light transmitting envelope containing a noble gas fill material and a pair of electrodes disposed in the envelope. Lead-in wires coupled to the electrodes and extend to and are hermetically sealed in the envelope The electrodes are disposed in oppositely spaced positions in the envelope preferably upper and lower positions with the electrodes positioned outside of the bulbous region of the envelope to thereby retard the formation of deposits at the main bulbous region of the envelope.

18 Claims, 1 Drawing Sheet

GLOW DISCHARGE LAMP

TECHNICAL FIELD

The present invention relates in general to a compact fluorescent lamp and pertains, more particularly, to a negative glow discharge lamp.

BACKGROUND

A glow lamp typically is comprised of a light transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation. Examples of typical glow discharge lamps are found in U.S. Pat. Nos. 2,067,129 to Marden; U.S. Pat. No. 3,814,971 to Bhattacharya; and U.S. Pat. No. 4,408,141 to Byszewski, et al.

Reference is also now made herein to a standard glow lamp construction as illustrated in the prior art drawing of FIG. 1. FIG. 1 illustrates a glow lamp including an envelope 10 that is provided with a phosphor coating as illustrated at 12. There are one or more electron emitting electrodes (cathodes) and one or more electron collecting electrodes (anodes). FIG. 1 in particular illustrates a cathode electrode 14 and an anode electrode 16. These electrodes are supported by respective lead-in wires 15 and 17.

In FIG. 1 the envelope 10 is generally of spherical shape having a generally maximum cross-section bulbous region 18 and also including a neck region 20. The lead-in wires 15 and 17 are typically hermetically sealed at the neck region 20 with a wafer stem assembly. In FIG. 1 the electrodes 14 and 16 are supported primarily in a side-by-side relationship and are approximately at the maximum cross section bulbous region 18.

In operation, the cathode emits electrons that are accelerated so that mercury vapor is excited in the extended region of the low pressure gas. In this connection the envelope may be filled with a conventional fill material including mercury and a noble gas or mixtures of noble gases. A suitable noble gas is neon. Furthermore, the lamp can be operated from either an AC or DC power source.

With the glow lamp construction as illustrated in FIG. 1, black deposits occur on the phosphor in the bulbous region 18 of the lamp seriously degrading the luminance output. Another drawback associated with the construction of FIG. 1 relates to the relatively close placement of the electrodes 14 and 16. This provides a relatively short arc length thus limiting the lamp voltage and attendant luminance output.

DISCLOSURE OF THE INVENTION

One object of the present invention is to provide an improved glow discharge lamp construction in which the bulbous region of the lamp envelope is substantially free from evaporants that result in black deposits on the phosphor.

Another object of the present invention is to provide an improved glow discharge lamp that can be operated at increased lamp voltage primarily by means of a longer arc discharge length.

A further object of the present invention is to provide an improved negative glow discharge lamp that is characterized by improved overall luminance output and operating life span.

To accomplish the foregoing and other objects, features and advantages of the invention there is provided a glow discharge lamp that is comprised of a light transmitting envelope containing a noble gas fill material and having a maximum cross section bulbous region. A pair of electrodes are disposed in the envelope and lead-in wires are associated with the electrodes for support thereof. These lead-in wires extend through and are hermetically sealed in the envelope. The electrodes are disposed in oppositely-spaced positions in the envelope and at least one of the electrodes is positioned outside of the bulbous region of the envelope to thereby retard the formation of deposits at the bulbous region. The envelope, in addition to containing the noble gas, usually also contains mercury and emits ultraviolet radiation upon excitation. A phosphor coating is also provided on the inner surface of the envelope. The phosphor coating emits visible light upon absorption of ultraviolet radiation. The envelope also includes at the base thereof a neck region with a lower electrode disposed at the neck region. In this connection a substantial portion of evaporants originating from the lower lamp electrode are confined to the neck region of the lamp leaving the light emitting phosphor area in the substantially bulbous portion of the lamp free from lower electrode evaporants. The envelope may also have at the top thereof a dome region with the upper electrode disposed at the dome region and also outside of the substantially bulbous region of the lamp envelope. The lead-in wires for the lower electrode are preferably disposed inside of the lead-in wires for the upper electrode. The electrodes may be excited from either a DC or AC source.

In accordance with still a further feature of the present invention, the electrodes are each preferably disposed closely adjacent the envelope wall. The electrodes are spaced apart by at least the maximum cross section of the bulbous region. The lead-in wires for the top electrode are electrically insulated. This may be carried out by coating the lead-in wires with an insulative material such as zirconium dioxide. Alternatively, the lead-in wires can be inserted in glass sleeves. Furthermore, metal disks may be used between these relatively substantially spaced electrodes. These disks serve a two-fold purpose; first to raise the voltage of the lamp and second to additionally contain electrode evaporants. The metal disks may also be phosphor coated to generate additional light output. These metal disks may be either substantially solid or provided with multiple holes therein.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
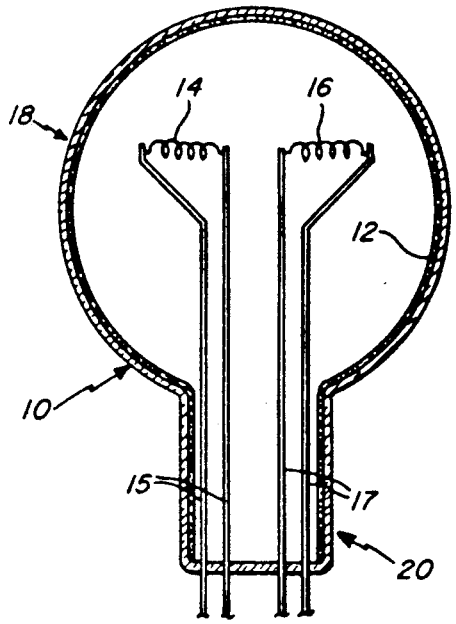
Fig. 1 (PRIOR ART)
FIG. 1 is a side elevation cross-sectional view of a standard glow discharge lamp.

Reference has been made in the background discussion herein to the standard glow lamp of FIG. 1. The electrodes 14 and 16 described therein are disposed in side-by-side position. The electrodes are located in the most bulbous region 18 of the envelope and are typically spaced approximately 1–3 centimeters apart. This placement of the electrodes causes a lamp blackening by the formation of black deposits on the phosphor particularly in the bulbous region 18 of the lamp.

Figure 2:
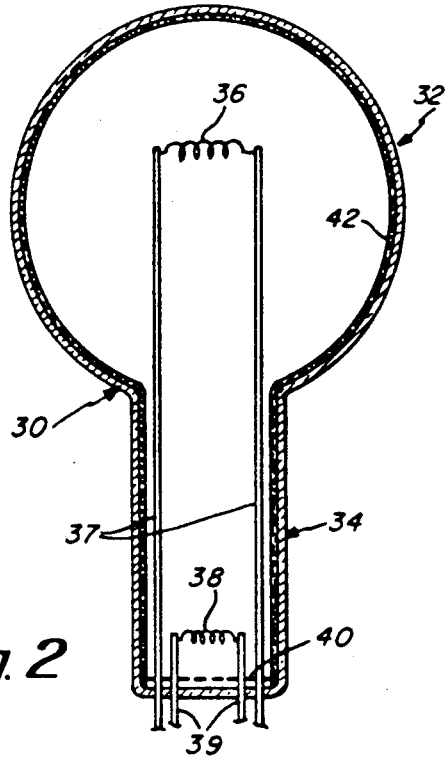
FIG. 2 is a side elevation cross-sectional view of a first embodiment of negative glow discharge lamp constructed in accordance with the present invention.
Figure 3:
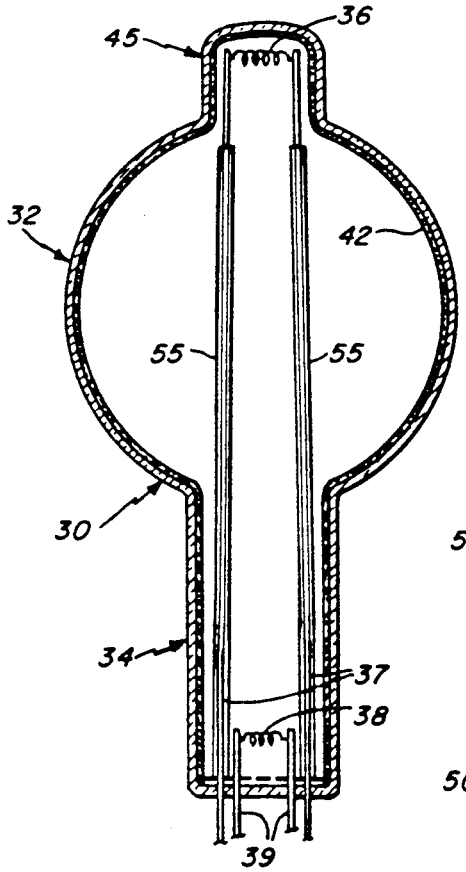
FIG. 3 is a side elevation cross-sectional view of a preferred embodiment of glow discharge lamp as in accordance with the present invention.
Figure 4:
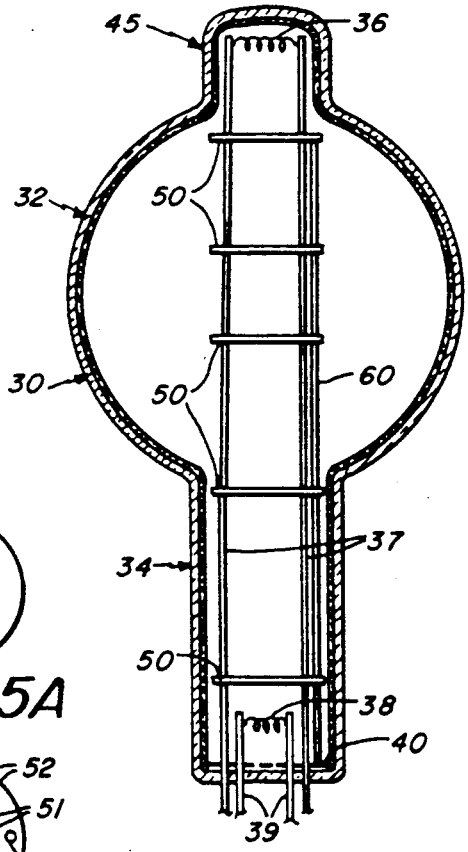
FIG. 4 is a side elevation cross-sectional view similar to that illustrated in FIG. 3 but showing the additional use of metal disks between electrodes.

Now, in accordance with the present invention as described in the embodiments illustrated in FIGS. 2–4, there are illustrated glow lamps wherein the electrodes are oppositely spaced in the envelope, one a lower electrode and the other an upper electrode spaced apart by at least the maximum cross section dimension of the bulbous region. It is noted that, particularly in the embodiments of FIGS. 3 and 4, the electrodes are not located in the bulbous region of the lamp envelope but rather in a region or regions where the surrounding walls are close to the electrode or electrodes. This thus dictates the preferred placement at opposite ends of the lamp envelope. This placement of the electrodes substantially eliminates or at the very least retards the formation of black deposits at the bulbous region of the lamp envelope.

Now, reference is made in particular to FIG. 2 for an illustration of the lamp envelope 30 that has a bulbous region 32 and a neck region 34. Within the envelope 30 is an upper electrode 36 and a lower electrode 38. Each of the electrodes may be standard #41 exciter coils available from GTE Products Corporation, Waldoboro, Me. The lower electrode 38 is disposed in a neck region 34. It is noted that the electrodes 36 and 38 are disposed apart by a distance that is actually greater than the maximum diameter of the bulbous region 32. Lead-in wires 37 support the electrode 36 and lead-in wires 39 support the electrodes 38. The lead-in wires may be rod-like of 20–30 mil diameter. Both of the lead-in wires 37 and 39 are hermetically sealed by means of a wafer stem assembly 40 that closes the bottom end of the neck region 34, as illustrated in FIG. 2.

In the embodiment of FIG. 2 the envelope 30 contains a fill material that emits ultraviolet radiation upon excitation. This fill material may contain mercury and a noble gas or mixture of noble gases. One suitable mixture is 99.5 percent neon and 0.5 percent argon at a pressure of from about 1 to 3 torr.

It has been found that by positioning the electrode or electrodes, particularly the lower electrode 38, away from the bulbous region of the lamp envelope, this retards the formation of black deposits on the phosphor in the bulbous region of the lamp. The phosphor is shown at 42 in FIG. 2 on the inner surface of the lamp envelope. In all of the embodiments illustrated on FIGS. 2–4 herein, it is noted that the lower electrode 38 is disposed in the neck region 34 of the lamp envelope. With this arrangement, a substantial portion of evaporants originating from the lower lamp electrode 38 are confined to the neck region 34 of the lamp envelope. This leaves the light emitting phosphor area, particularly in the bulbous region 32 of the lamp, free from lower electrode evaporants.

Moreover, it has been found that evaporants can be substantially reduced by the preferred embodiment of FIG. 3 in particular. In this embodiment both electrodes are outside the bulbous region 32. In this regard the lamp envelope has a minor bulbous region or dome region 45 at the very top thereof as illustrated in both FIGS. 3 and 4. This region formed at the top of the lamp envelope serves to collect evaporants from the upper electrode 36. Note in FIGS. 3 and 4 that the electrode 36 is disposed directly in the top dome region 45. The combination of the upper and lower essentially shielded electrodes is effective in reducing lamp blackening in the main bulbous region 32 of the lamp envelope 30.

Reference is now made to still a further embodiment of the present invention illustrated in FIG. 4. The embodiment of FIG. 4 is similar to the embodiment of FIG. 3 but additionally illustrates the use of metal disks that are used generally in the area between the electrodes 36 and 38. These metal disks 50 are disposed in a substantially, vertically arranged array with each disk 50 disposed substantially horizontally. These metal disks 50 serve a two-fold purpose; first to raise the voltage of the lamp and, second, they additionally contain electrode evaporants. Also, the disks 50 may be phosphor coated to generate additional light if desired.

The metal disks 50 may be supported from the lead-in wires 37 and for that purpose the metal disks are provided with a pair of holes 51. The lead-in wires 37 are insulated, as will be described in further detail hereinafter, so that the metal disks 50 do not short-out the lead-in wires.

Figure 5A:
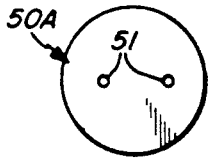
FIG. 5A and 5B show alternate embodiments of the metal disks employed in the lamp of FIG. 4.
Figure 5B:
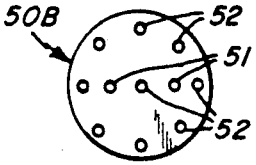

Reference is now made to FIGS. 5A and 5B for alternate embodiments of the metal disks. FIG. 5A shows a metal disk 50A which is of substantially solid construction. The metal disk 50B is provided with several through holes 52 about the periphery thereof and at the center. The disk 50B permits portions of the discharge to pass therethrough. Alternatively, the metal disk 50A forces the discharge to pass about the annular space between the disks and lamp walls.

As indicated previously, the metal disks may be provided with a pair of holes 51 so that they can fit over the lead-in wires 37, or in the embodiment of FIG. 3, fit over the glass sleeves 55. The holes 51 are properly dimensioned to fit either the coated wires or the glass sleeves. The metal disks 50 are preferably supported in proper spaced relationships by means of a support rod 60, as illustrated in FIG. 4. The rod 60 may be tack welded to the edge of each of the metal disks 50 and may be supported at its bottom end at the wafer stem assembly 40. In assembling the metal disks, they may be secured by means of the rod 60 to dispose them in proper spaced relationship and may thereafter be slid over the lead-in wires 37. The electrode 36 is then thereafter attached at the top of the lead-in wires 37.

In all embodiments of the present invention described herein, the lead wires 37 extending to the upper electrode 36 are electrically insulated to prevent undesired arcing between electrode 38 and the lead wires 37. In the embodiments of FIGS. 2 and 4 this may be achieved by coating the lead wires with an insulative material such as zirconium dioxide. In the embodiment of FIG. 3, alternatively the lead wires 37 are insulated by means of the glass sleeves 55. The insulating means should extend down to wafer stem 40 for proper operation.

Thus, in accordance with the present invention there has now been defined in several embodiments herein, an improved negative glow discharge lamp that is constructed, particularly with respect to its electrode positioning, so that evaporants from one or more of the electrodes are collected in predetermined regions of the lamp envelope particularly outside of the primary bulbous region of the lamp envelope. Another novel aspect of the present invention is that, with the particular electrode placement construction described herein, the lamp voltage can be increased because of the longer arc length. This lamp voltage is also increased with the use of metal disks forming a metal shield means disposed between the spaced electrodes.

While there have been shown and described what are at present considered the preferred embodiments of the invention, it will be obvious to those skilled in the art that various changes and modifications may be made therein without departing from the scope of the invention as defined by the appended claims.

What is claimed is:

1. A glow discharge lamp comprising;

a light transmitting envelope containing a noble gas fill material and having a maximum cross-section bulbous region, a neck region, and a dome region at the top thereof outside said bulbous region, a pair of electrodes disposed in said envelope, and lead-in wires coupled to the electrodes and extending through and hermetically sealed in said envelope, said electrodes being disposed in oppositely spaced positions in the envelope, one of said electrodes being disposed in said dome region, the other of said electrodes being positioned outside of said bulbous region at said neck region of the envelope such that a substantial portion of the evaporants originating from said other of said electrodes is confined to said neck region to thereby retard the formation of deposits at said bulbous region.

2. A glow discharge lamp as set forth in claim 1 wherein the envelope also contains mercury and emits ultraviolet radiation upon excitation.

3. A glow discharge lamp as set forth in claim 2 including a phosphor coating on an inner surface of said envelope and which emits visible light upon absorption of ultraviolet radiation.

4. A glow discharge lamp comprising claim 3 wherein lead-in wires for said other electrode are disposed inside of the lead-in wires for said one electrode.

5. A glow discharge lamp comprising claim 1 wherein said electrodes are excited from a DC source.

6. A glow discharge lamp comprising claim 1 wherein said electrodes are excited from an AC source.

7. A glow discharge lamp comprising claim 1 wherein said electrodes are disposed at respective top and bottom sections of the envelope with each electrode disposed closely adjacent the envelope wall.

8. A glow discharge lamp comprising claim 7 wherein the electrodes are spaced apart by at least said maximum cross-section.

9. A glow discharge lamp comprising claim 7 wherein the lead-in wires for the bottom electrode are disposed inside of the lead-in wires for the top electrode.

10. A glow discharge lamp comprising claim 9 wherein the lead-in wires for the top electrode are electrically insulated.

11. A glow discharge lamp comprising claim 10 wherein the lead-in wires for the top electrode are insulated by coating with an insulative material.

12. A glow discharge lamp comprising claim 7 including disk means in said envelope supported between electrodes.

13. A glow discharge lamp comprising claim 12 wherein said disk means comprises a substantially solid disk.

14. A glow discharge lamp comprising claim 12 wherein said disk means comprises a series of vertically spaced and horizontally disposed disks having a phosphor coating thereon.

15. A glow discharge lamp comprising claim 12 wherein said disk means comprises a disk with multiple holes therein.

16. A glow discharge lamp comprising claim 1 wherein said one electrode is disposed at the top of the envelope closely adjacent the envelope wall.

17. A glow discharge lamp comprising claim 1 wherein both said electrodes are disposed outside of said bulbous region at respective upper and lower envelope areas.

18. A glow discharge lamp comprising claim 17 wherein each electrode is disposed closely adjacent the envelope wall with the lead-in wires for the upper electrode being electrically insulated.

* * * * *